US009431696B2

(12) United States Patent
Wong et al.

(10) Patent No.: US 9,431,696 B2
(45) Date of Patent: Aug. 30, 2016

(54) COMMUNICATION DEVICE WITH GROUND PLANE ANTENNA

(71) Applicant: Acer Incorporated, New Taipei (TW)

(72) Inventors: Kin-Lu Wong, New Taipei (TW); Tseng-Wei Weng, New Taipei (TW)

(73) Assignee: Acer Incorporated, New Taipei (TW)

( * ) Notice: Subject to any disclaimer, the term of this patent is extended or adjusted under 35 U.S.C. 154(b) by 0 days.

(21) Appl. No.: 13/949,245

(22) Filed: Jul. 24, 2013

(65) Prior Publication Data

US 2014/0327593 A1 Nov. 6, 2014

(30) Foreign Application Priority Data

May 2, 2013 (TW) ..... 102115722 A

(51) Int. Cl.

| | |
|---|---|
| ***H01Q 1/38*** | (2006.01) |
| ***H01Q 1/48*** | (2006.01) |
| ***H01Q 9/26*** | (2006.01) |
| ***H01Q 1/24*** | (2006.01) |
| ***H01Q 9/04*** | (2006.01) |
| *H01Q 5/364* | (2015.01) |

(52) U.S. Cl.

CPC ..... *H01Q 1/48* (2013.01); *H01Q 1/243* (2013.01); *H01Q 1/38* (2013.01); *H01Q 9/0414* (2013.01); *H01Q 9/26* (2013.01); *H01Q 5/364* (2015.01)

(58) Field of Classification Search

CPC .... H01Q 1/38; H01Q 9/0414; H01Q 9/0421; H01Q 9/16; H01Q 9/0407; H01Q 1/2283; H01Q 5/364

USPC ..... 343/702, 846, 700 MS, 848, 793, 794

See application file for complete search history.

(56) References Cited

U.S. PATENT DOCUMENTS

| | | | | |
|---|---|---|---|---|
| 5,262,791 | A | 11/1993 | Tsuda et al. | |
| 7,853,232 | B2 * | 12/2010 | Noro | 455/293 |
| 2003/0193439 | A1 | 10/2003 | Park | |
| 2006/0176220 | A1 | 8/2006 | Tamaoka | |
| 2007/0069957 | A1 * | 3/2007 | Ranta | 343/700 MS |
| 2007/0164868 | A1 * | 7/2007 | Deavours et al. | 340/572.7 |
| 2007/0176834 | A1 | 8/2007 | Mohammadian et al. | |
| 2008/0136730 | A1 * | 6/2008 | Chen | 343/867 |
| 2009/0243940 | A1 * | 10/2009 | Humphrey | 343/700 MS |

FOREIGN PATENT DOCUMENTS

| | | |
|---|---|---|
| CN | 1906807 | 1/2007 |
| CN | 101567483 | 10/2009 |
| EP | 2107635 | 10/2009 |
| EP | 2139065 | 12/2009 |

* cited by examiner

*Primary Examiner* — Dameon E Levi
*Assistant Examiner* — Ricardo Magallanes
(74) *Attorney, Agent, or Firm* — Jianq Chyun IP Office

(57) ABSTRACT

A communication device including a ground element, a dielectric substrate, and an antenna element is provided. The dielectric substrate is disposed nearby the ground element and has a first surface and a second surface. The antenna element includes a first metal portion and a second metal portion. The first metal portion is disposed on the first surface and has a feeding point. The second metal portion is disposed on the second surface. The first metal portion is electrically connected to the second metal portion through a conductive via-hole, and the conductive via-hole is located at or nearby a first edge of the first metal portion. The first edge is away from the ground element. The projection of the second metal portion on the first surface is covered by the first metal portion.

8 Claims, 3 Drawing Sheets

1

COMMUNICATION DEVICE WITH GROUND PLANE ANTENNA

CROSS-REFERENCE TO RELATED APPLICATION

This application claims the priority benefit of Taiwan application serial no. 102115722, filed on May 2, 2013. The entirety of the above-mentioned patent application is hereby incorporated by reference herein and made a part of this specification.

BACKGROUND OF THE INVENTION

1. Field of the Invention

The invention relates to a communication device, and more particularly, to a communication device with a ground plane antenna.

2. Description of Related Art

In recent years, with the rapid advances in the wireless communication technology, the communication device not only is demanded for its function, but the appearance thereof is also designed to be thinner and lighter to attract the consumer's attention. Therefore, how to utilize limited space to design an antenna element having a small size and achieve broadband or multi-frequency operation has become an important issue in the design of the antenna.

Accordingly, when it comes to designing an antenna for a communication device, how to combine an antenna element having a small size with a ground plane of the device to form a ground plane antenna with a broadband resonant mode and improve the impedance matching and the antenna efficiency in an operating band of the ground plane antenna has become a major issue in the design of the antenna.

SUMMARY OF THE INVENTION

The invention provides a communication device that uses an antenna element and a ground element in the communication device to form a ground plane antenna with an asymmetric dipole antenna structure, and two metal portions disposed on different surfaces of a dielectric substrate in the antenna element are connected with each other through a conductive via-hole. In this way, the impedance matching of the resonant mode of the ground plane antenna can be improved, and thus the operating bandwidth and the antenna efficiency of the ground plane antenna can be increased.

The communication device of the invention includes a ground element, a dielectric substrate, and an antenna element. The dielectric substrate is disposed nearby the ground element and has a first surface and a second surface. The antenna element includes a first metal portion and a second metal portion. The first metal portion is disposed on the first surface and has a feeding point. The second metal portion is disposed on the second surface. The first metal portion is electrically connected to the second metal portion through a conductive via-hole, and the conductive via-hole is located at or nearby a first edge of the first metal portion. The first edge is away from the ground element. The projection of the second metal portion on the first surface is covered by the first metal portion.

To make the above features and advantages of the invention more comprehensible, several embodiments accompanied with drawings are described in detail as follows.

BRIEF DESCRIPTION OF THE DRAWINGS

The accompanying drawings are included to provide a further understanding of the invention, and are incorporated in and constitute a part of this specification. The drawings illustrate embodiments of the invention and, together with the description, serve to explain the principles of the invention.

DESCRIPTION OF THE EMBODIMENTS

In order to make the above objectives, features and advantages of the invention more comprehensible, several specific embodiments accompanied with figures are described in detail as follows.

Figure 1:
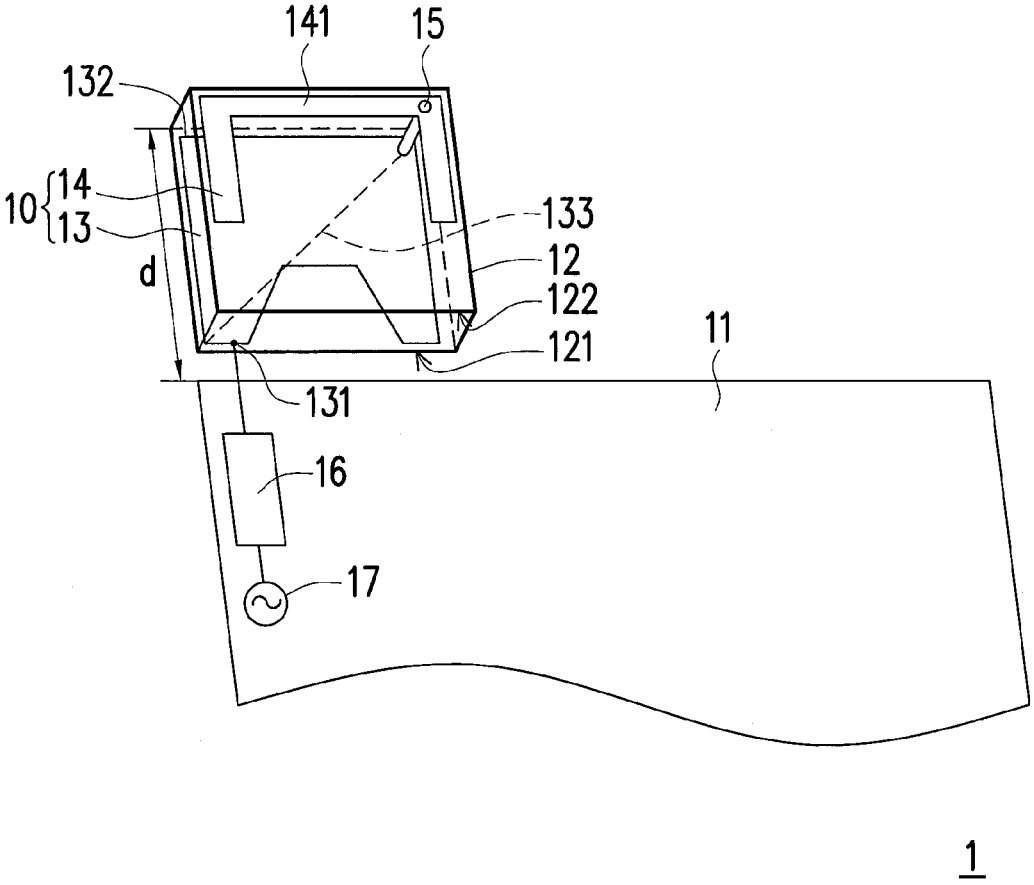
FIG. 1 is a schematic diagram illustrating a structure of a communication device according to a first embodiment of the invention.

FIG. 1 is a schematic diagram illustrating a structure of a communication device according to a first embodiment of the invention. Referring to FIG. 1, a communication device 1 includes a ground element 11, a dielectric substrate 12, and an antenna element 10. The dielectric substrate 12 has a first surface 121 and a second surface 122, and the antenna element 10 has a first metal portion 13 and a second metal portion 14.

A shape of the first metal portion 13 is approximately an inverted U shape and the first metal portion 13 is disposed on the first surface 121. Moreover, the first metal portion 13 has a feeding point 131 and a first edge 132, and the first edge 132 is an edge of a middle section of the inverted U shape and is away from the ground element 11. From another perspective, the first metal portion 13 further includes a second edge opposite to the first edge 132. The second edge of the first metal portion 13 includes a notch such that the shape of the first metal portion 13 is approximately the inverted U shape. Moreover, the feeding point 131 is disposed on the second edge of the first metal portion 13 and is nearby a sidewall of the notch. Furthermore, an opening of the notch of the first metal portion 13 is opposite to the ground element 11, and the first edge 132 and the ground element 11 are spaced by a first distance d. A length of the first edge 132 is between 0.5 to 2.0 times the first distance d.

A shape of the second metal portion 14 is also approximately an inverted U shape, and the second metal portion 14 is disposed on the second surface 122. Moreover, a middle section 141 of the inverted U shape is disposed nearby the first edge 132 and is substantially parallel to the first edge 132. Furthermore, a projection of the second metal portion 14 on the first surface 121 is covered by the first metal portion 13. That is, the second metal portion 14 is opposite to the first metal portion 13 with the dielectric substrate 12 in between.

In addition, the first metal portion 13 is electrically connected to the second metal portion 14 through a conductive via-hole 15. The conductive via-hole 15 passes through the first metal portion 13, the dielectric substrate 12, and the second metal portion 14. Moreover, regarding the first metal portion 13, the conductive via-hole 15 is located at or nearby an end of the first edge 132, and the conductive via-hole 15 and the feeding point 131 are nearby two ends of a diagonal 133 of the first metal portion 13, respectively. Furthermore, regarding the second metal portion 14, the conductive via-hole 15 is located at or nearby a corner of the second metal portion 14.

The antenna element 10 and the ground element 11 form a ground plane antenna having an asymmetric dipole antenna structure. Moreover, the communication device 1 transmits a signal source 17 to the feeding point 131 to excite the antenna element 10. Therefore, the first metal portion 13 can generate a resonant mode in a frequency band such that the antenna element 10 is operated in the frequency band. Moreover, as shown in FIG. 1, in an embodiment, the communication device 1 further includes a matching circuit 16, and the matching circuit 16 is electrically connected to the first metal portion 13. During the operation, the matching circuit 16 provides an impedance value such that the antenna element 10 is operated in the frequency band. Moreover, with the arrangement of the matching circuit 16, the sum of the lengths of the first edge 131 and the first distance d is less than 0.1 times a wavelength of a lowest frequency of the frequency band and is far less than a resonance path length of a quarter wavelength required by a conventional antenna element.

It should be mentioned that, in the situation where the second metal portion 14 is not arranged, the distribution of the surface current of the first metal portion 13 may not be very uniform. For instance, since the first edge 132 of the first metal portion 13 is away from the feeding point 131, a region nearby the first edge 132 in the first metal portion 13 becomes the region having weaker surface current in the first metal portion 13. However, with the arrangement of the second metal portion 14, since the first metal portion 13 can be electrically connected to the second metal portion 14 through the conductive via-hole 15 and the conductive via-hole 15 is located at or nearby the first edge 132, the surface current of the first metal portion 13 can be distributed more uniformly through the second metal portion 14. Hence, the effects of improving the impedance matching of the ground plane antenna formed by the antenna element 10 and the ground element 11 and increasing the antenna efficiency and the operating bandwidth of the ground plane antenna can be achieved.

Figure 2:
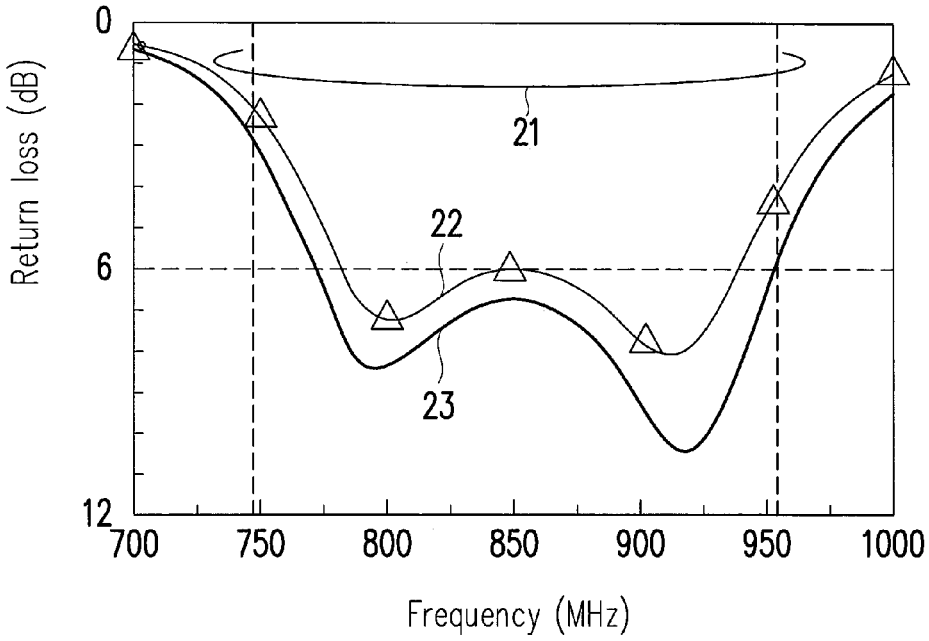
FIG. 2 is a return loss diagram of the communication device according to the first embodiment of the invention with a second metal portion and without a second metal portion.

For instance, FIG. 2 is a return loss diagram of the antenna element 10 according to the first embodiment of the invention with the second metal portion 14 and without the second metal portion 14. The dimension of the antenna element 10 in the present embodiment is only about $10\times10\times1$ $mm^3$, and the dimension of the antenna element 11 is about $110\times60$ $mm^2$. As shown in FIG. 2, the antenna element 10 is operated in a frequency band 21 and the frequency range of the frequency band 21 is about 746-960 MHz, and covers the frequency bands of LTE band 13 and GSM850/900. Moreover, a return loss curve 22 is used to represent the return loss of the antenna element 10 without the second metal portion 14, and the return loss curve 23 is used to represent the return loss of the antenna element 10 with the second metal portion 14. By comparing the return loss curves 22 and 23, it is apparent that, with the arrangement of the second metal portion 14, the return loss of the antenna element 10 can be improved from the return loss curve 22 to the return loss curve 23. Moreover, the improvement of the return loss is at least about 1 dB, and the maximum improvement is about 2.7 dB. Therefore, the operating bandwidth of the antenna element 10 is effectively increased.

Figure 3:
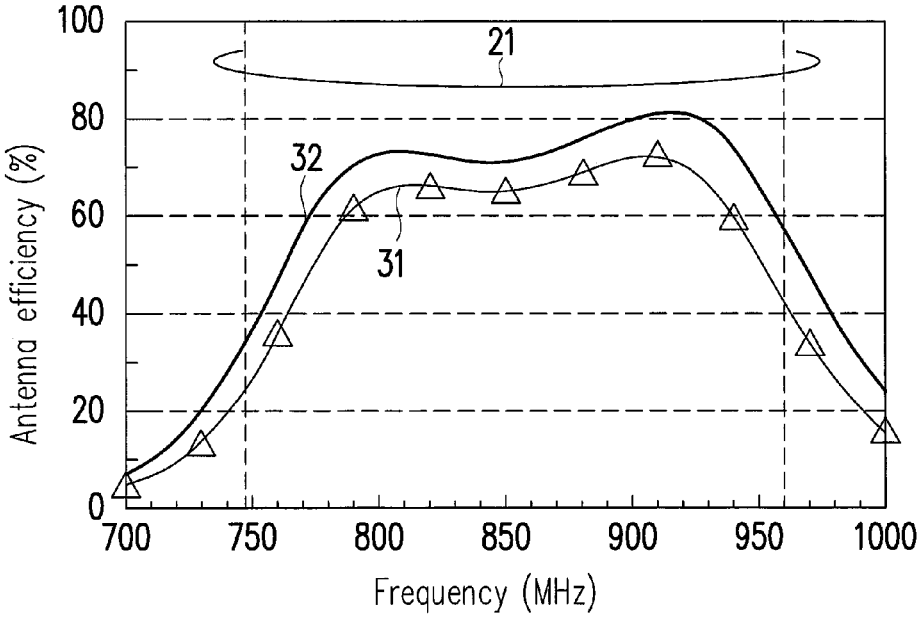
FIG. 3 is an antenna efficiency diagram of the communication device according to the first embodiment of the invention with a second metal portion and without a second metal portion.

FIG. 3 is an antenna efficiency diagram of the antenna element 10 according to the first embodiment of the invention with the second metal portion 14 and without the second metal portion 14. An antenna efficiency curve 31 (the mismatching loss of the antenna is included) is used to represent the antenna efficiency of the antenna element 10 without the second metal portion 14, and the antenna efficiency curve 32 (the mismatching loss of the antenna is included) is used to represent the antenna efficiency of the antenna element 10 with the second metal portion 14. By comparing the antenna efficiency curves 31 and 32, it is apparent that, with the arrangement of the second metal portion 14, the antenna efficiency of the antenna element 10 can be improved from the antenna efficiency curve 31 to the antenna efficiency curve 32. Moreover, the average improvement of the antenna efficiency in the frequency band 21 is about 10%, and the maximum improvement is about 14%.

Figure 4:
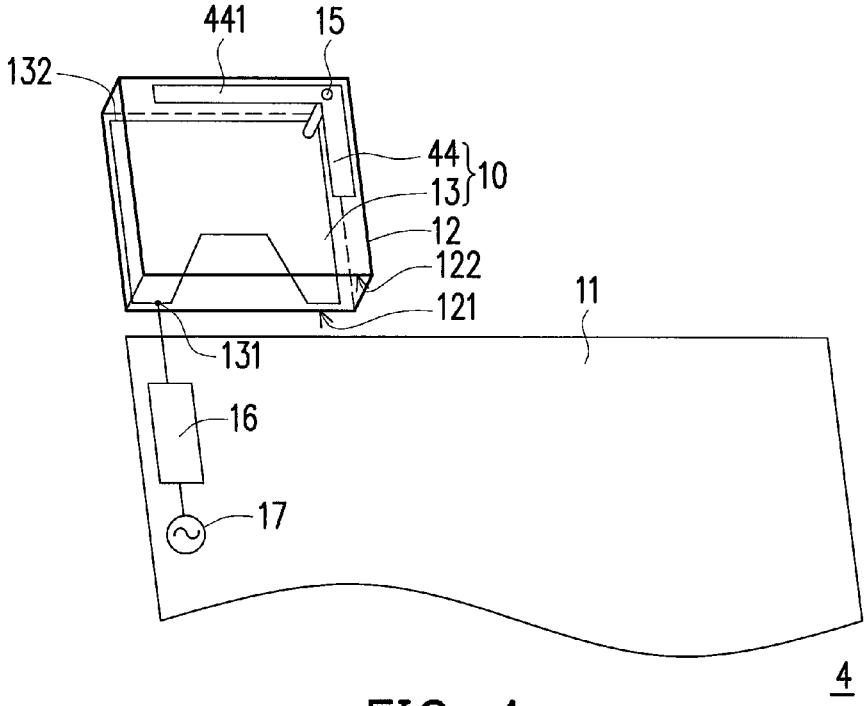
FIG. 4 is a schematic diagram illustrating a structure of a communication device according to a second embodiment of the invention.

FIG. 4 is a schematic diagram illustrating a structure of a communication device according to a second embodiment of the invention. The communication device 4 in the second embodiment is similar to the communication device 1 in the first embodiment. The difference between the second embodiment and the first embodiment is that a shape of the second metal portion 44 in the antenna element 10 is approximately an inverted L shape. Moreover, a section 441 of the inverted L shape is nearby the first edge 132 and is substantially parallel to the first edge 132. Under the similar structure, the communication device 4 in the second embodiment can also achieve an effect similar to the first embodiment.

Figure 5:
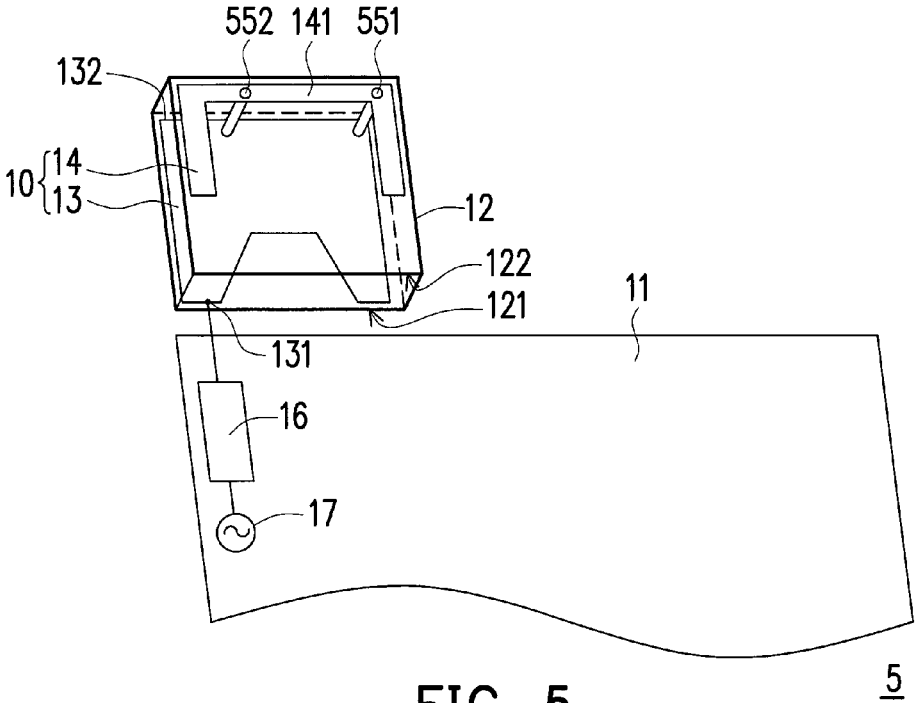
FIG. 5 is a schematic diagram illustrating a structure of a communication device according to a third embodiment of the invention.

FIG. 5 is a diagram illustrating a structure of a communication device according to a third embodiment of the invention. The communication device 5 in the third embodiment is similar to the communication device 1 in the first embodiment. The difference between the third embodiment and the first embodiment is that the first metal portion 13 is electrically connected to the second metal portion 14 through two conductive via-holes 551 and 552. Under the similar structure, the communication device 5 in the third embodiment can also achieve an effect similar to the first embodiment.

Based on the above, in the invention, the antenna element and the ground element in the communication device are used to form the ground plane antenna having the asymmetric dipole antenna structure. Moreover, the antenna element has two metal portions respectively disposed on different surfaces of the dielectric substrate, and the two metal portions are connected with each other through the conductive via-hole. In this way, the impedance matching of the resonant mode of the ground plane antenna can be improved, and thus the operating bandwidth and the antenna efficiency of the ground plane antenna can be increased.

Although the invention has been described with reference to the above embodiments, it will be apparent to one of the ordinary skill in the art that modifications to the described embodiments may be made without departing from the spirit of the invention. Accordingly, the scope of the invention is defined by the attached claims not by the above detailed descriptions.

What is claimed is:

1. A communication device, comprising:

a ground element;

a dielectric substrate, disposed nearby the ground element, the dielectric substrate having a first surface and a second surface; and an antenna element, consisting essentially of a first metal portion and a second metal portion, wherein the antenna element and the ground element form a ground plane antenna, a feeding point is disposed on the first metal portion, the first metal portion is disposed on the first surface, the second metal portion is disposed on the second surface, the first metal portion is electrically connected to the second metal portion through a conductive via-hole, wherein the first metal portion comprises a first edge away from the ground element and a second edge nearby the ground element, a first end of a diagonal of the first metal portion connects an end of the first edge, and a second end of the diagonal of the first metal portion connects an end of the second edge, wherein the feeding point is nearby the second end of the diagonal of the first metal portion and the conductive via-hole is nearby the first end of the diagonal of the first metal portion, such that a surface current flowing through the first metal portion electrically connected to the second metal portion is distributed more uniformly than that of the first metal portion which is not electrically connected to the second metal portion, and a projection of e second metal portion on the first surface is covered by the first metal portion, wherein a shape of the first metal portion is an inverted U shape and the first edge is an edge of a middle section of the inverted U shape, and the conductive via-hole is located at or nearby a corner of the second metal portion.

2. The communication device of claim 1, wherein the second edge is opposite to the first edge and the feeding point is disposed on the second edge.

3. The communication device of claim 1, wherein the second edge comprises a notch, an opening of the notch is opposite to the ground element, and the feeding point is disposed nearby a sidewall of the notch.

4. The communication device of claim 1, wherein the first edge and the ground element are spaced by a first distance and a length of the first edge is between 0.5 to 2.0 times the first distance.

5. The communication device of claim 4, further comprising:

a matching circuit, electrically connected the first metal portion, wherein the matching circuit provides an impedance value such that the antenna element is operated in a frequency band and a sum of the lengths of the first edge and the first distance is less than 0.1 times a wavelength of a lowest frequency of the frequency band.

6. The communication device of claim 1, wherein the conductive via-hole passes through the first metal portion, the dielectric substrate, and the second metal portion.

7. The communication device of claim 1, wherein a shape of the second metal portion is an inverted L shape, and a section of the inverted L shape is nearby the first edge and substantially parallel to the first edge.

8. The communication device of claim 1, wherein a shape of the second metal portion is an inverted U shape, and a middle section of the inverted U shape is nearby the first edge and substantially parallel to the first edge.

* * * * *